United States Patent [19]

Marshall

[11] 4,250,691

[45] Feb. 17, 1981

[54] FEEDING APPARATUS

[75] Inventor: Steven Marshall, Mentone, Australia

[73] Assignee: ACI Operations Pty. Ltd., Melbourne, Australia

[21] Appl. No.: 47,936

[22] Filed: Jun. 12, 1979

[51] Int. Cl.[3] ..... B65B 57/06; B65B 43/12; B65B 43/40

[52] U.S. Cl. ..... 53/505; 53/512; 53/173; 53/251; 53/268; 53/300; 53/381 A

[58] Field of Search ..... 53/468, 492, 505, 170, 53/173, 251, 268, 273, 300, 381 A, 512

[56] References Cited

U.S. PATENT DOCUMENTS

| | | | |
|---|---|---|---|
| 3,447,281 | 6/1969 | Buford et al. | 53/381 A X |
| 3,479,795 | 11/1969 | Martin | 53/273 X |
| 3,516,220 | 6/1970 | Buford et al. | 53/300 X |
| 4,077,182 | 3/1978 | Papaluca | 53/381 A X |
| 4,120,134 | 10/1978 | Scholle | 53/268 X |
| 4,124,967 | 11/1978 | Beer et al. | 53/505 X |

*Primary Examiner*—Travis S. McGehee

*Attorney, Agent, or Firm*—Cushman, Darby & Cushman

[57] ABSTRACT

An apparatus for feeding an elongate continuous web of bags, which are provided with a feed member through which the bags may be filled, to a filling machine is disclosed. The apparatus has a conveyor, guide means mounted above the conveyor arranged to guide the movement of each of the feed members, sensing means for sensing the presence of the feed member and gripping means responsive to the sensing means for holding each feed member.

9 Claims, 4 Drawing Figures

FEEDING APPARATUS

This invention relates to an apparatus which is adapted to fill bags or pouches joined together to form a continuous web, with fluent material.

Containers for fluent material comprising a rigid outer container having disposed therein a flexible bag or lining of plastics material have been used for some time in the packaging industry. Tapping means in the form of a valve closure or tap are provided at or near the base of the outer container in communication with the fluid held in the bag or lining, whereby the liquid therein may be dispensed in desired quantities.

The outer container may also be provided with a vent, usually at or near its upper end, so that when liquid is withdrawn from within the flexible lining air will flow into the container outside the flexible lining to cause the lining to collapse around the liquid remaining in it. In this form of container the air admitted through the vent does not come in contact with the liquid, so that even a liquid which deteriorates when exposed to air may be stored for an appreciable period. Such containers are known as "bag-in-box" containers.

Generally bag-in-box containers are supplied to packagers in the form of separate components which may be readily assembled. For example, the components may be a cardboard box blank, and a single or multilayered flexible bag having a valve closure or tap which also doubles as a feed member through which the bag may be filled with liquid.

The bags are generally filled by an operation using manually operated or semi-automatic filling machinery. The operator takes unfilled bags, presents them one by one to the filling machine and initiates a cycle during which the filling machine meters a predetermined amount of product fluid into the bag through a spout which forms part of the closure or tap. After the filling step, the operator inserts each of the filled bags into a cardboard box which has been separately erected from a flat blank.

Whilst the aforesaid method works effectively, it is limited by the fact that an operator must be in constant attendance feeding bags and removing them and also by the fact that the speed of the process depends on the rate at which the operator works.

The present invention seeks to minimise the aforesaid limitations by providing an apparatus for automatically feeding a continuous web of bags which are each provided with a protruding feed member such as a valve closure or tap, to a filling machine. The bags forming the web are joined end to end and each feed member is of a construction which allows the bag to be filled therethrough.

In accordance with the invention there is provided an apparatus for feeding an elongate continuous web of bags which are each provided with a protruding feed member through which the bags may be filled, to a filling machine, comprising a web conveyor, guide means mounted above said web conveyor, said guide means being arranged to guide the movement of each said protruding feed member, sensing means for sensing the presence of the feed member being guided by said guide means and gripping means responsive to said sensing means, for holding each said feed member, said gripping means comprising a pair of opposed pivotally mounted gripper arms.

For simplicity of construction, the web conveyor may suitably comprise a plurality of rollers, at least some of which are arranged in descending height, in order that the weight of liquid filled bags allows the web to be gravity fed to the filling device. Alternatively, a motorised web conveyor arrangement can be used.

The sensing arrangement may comprise any conventional sensing device, such as one or more reed switches, pneumatic switches or photo-electric cells, arranged to operate the gripper arms when the feed member of an unfilled bag has been moved into registry with the filling device. In the most preferred arrangement, a pneumatic switch will be located so that it is actuated by a feed member approaching close to the gripper arms, and a second pneumatic switch is located up stream of the gripper arms to sense when a feed member on a filled bag has been released thereby.

Preferably, the feeding apparatus also includes separating means located downstream of the filling station, the separating means severing individual filled bags from the web.

An apparatus constructed according to the invention is particularly suitable for filling individual bags on a web through feed members in the form of two component closures, known as Fattori valves, which are described in Australian patent specification No. 446,218.

Fattori valves generally comprise a spout member provided at one end with a circumferential flange which is glued or welded to a plastic bag containing liquid. The spout which communicates with the liquid in the bag is provided at the opposite end with an elastomeric closure member snap fitted thereto. The elastomeric closure which ordinarily seals the spout has a toggle member which may be manipulated to distort a part thereof, thereby breaking the seal and allowing liquid to flow through a dispensing orifice provided therein.

As the elastomeric closure is snap fitted to the spout, it is readily removable by a filling machine to leave an open spout through which each bag may be filled.

In another aspect, the invention provides an assembly for simultaneously filling a plurality of webs of bags which separates filled bags and places them in outer containers. This assembly may incorporate a number of web feeding devices as hereinbefore defined.

More specifically, the assembly comprises an apparatus for filling flexible bags with liquid and placing each filled bag in an outer container, comprising a plurality of driven web conveyors which are each adapted to feed an elongate web of bags provided with a protruding feed member through which the bags may be filled, guide means provided in association with each web conveyor, said guide means adapted for guiding the movement of said feed members to a filling machine mounted above each said web conveyor, each said filling machine including gripping means for holding a feed member and being adapted to fill said bags through each feed member held by said gripping means, a separating device capable of separating filled bags from the web mounted above each said web conveyor downstream of each said filling machine, a container feed conveyor running along the downstream ends of said web conveyors, a chute provided at the downstream end of each web conveyor, each said chute being adapted to drop filled bags provided by said web conveyor into outer containers provided by said container feed conveyor and pusher means provided at the downstream end of each web conveyor, said pusher means acting to push outer containers from said container feed conveyor onto a filled container outlet conveyor which runs substantially parallel to said container feed conveyor.

Preferred forms of the invention will be described with reference to the accompanying drawings, wherein.

Figure 1:
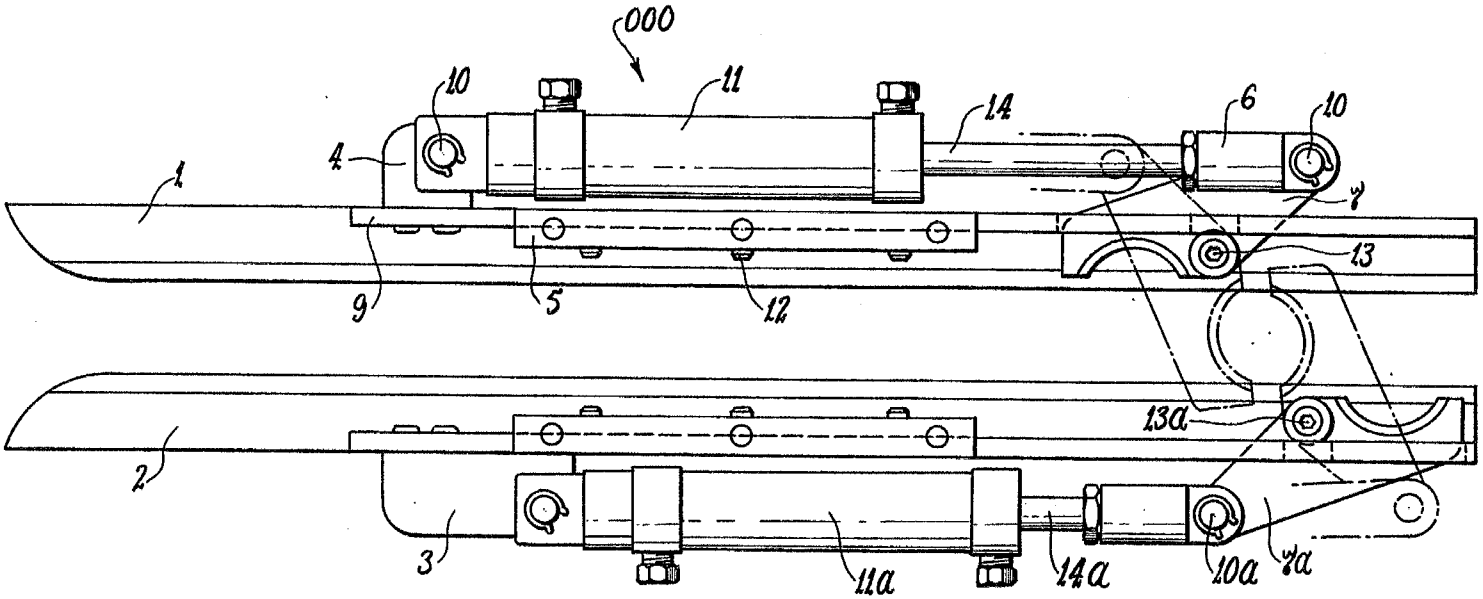
FIG. 1 illustrates a plan view of part of the feeding assembly manufactured in accordance with the invention.

The feeding assembly shown in FIG. 1 and designated 000, includes but does not show, a feed conveyor provided thereunder for feeding a continuous web of bags, each provided with a feed member in the form of a protruding Fattori valve, in the direction from the left to the right of the drawing.

Parallel guide rails 1 and 2 are located to direct the travel of the protruding valves therebetween, in order that they can be readily grasped by the pair of gripper arms 7 and 7A. The gripper arms 7 and 7A, are pivotally mounted on the socket shoulder screws 13 and 13A, which are themselves attached to the guide rails, in order that they be moved from the "open" position shown in dark lines, to the "closed" position, shown in faint lines.

Means for moving the gripper arms between their "open" and "closed" positions may comprise a pair of air cylinders 11 and 11A, mounted on either side of the guide rails by means of the mounting plates 3 and 4. Each of the gripper arms are pivotally attached by means of pins 10 and 10A to the piston arms 14 and 14A of the air cylinders.

Operation of the air cylinders is controlled by sensing means (not shown) which detect the presence of the protruding closure of an unfilled bag when it approaches the region of the gripper arms. The sensing means may comprise a pneumatic switch (not shown) which triggers the gripper arms to assume a closed position when a closure is sensed. A further sensing means (not shown) such as another pneumatic switch may also be provided to sense when the valve of a filled bag has been released thereby.

Figure 3:
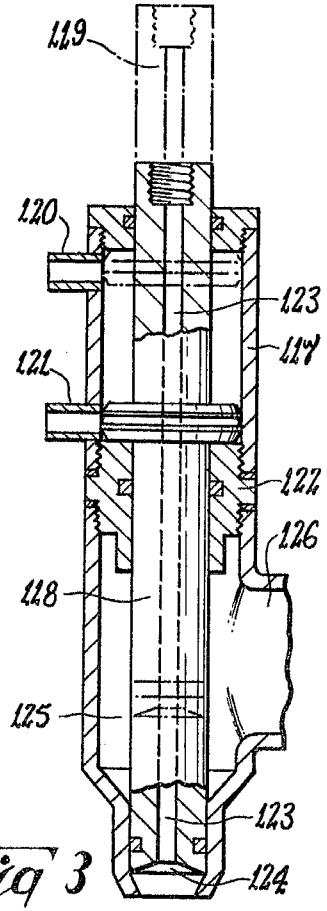
FIG. 3 is a sectional front elevation of the fill head of the device of FIG. 2.
Figure 2:
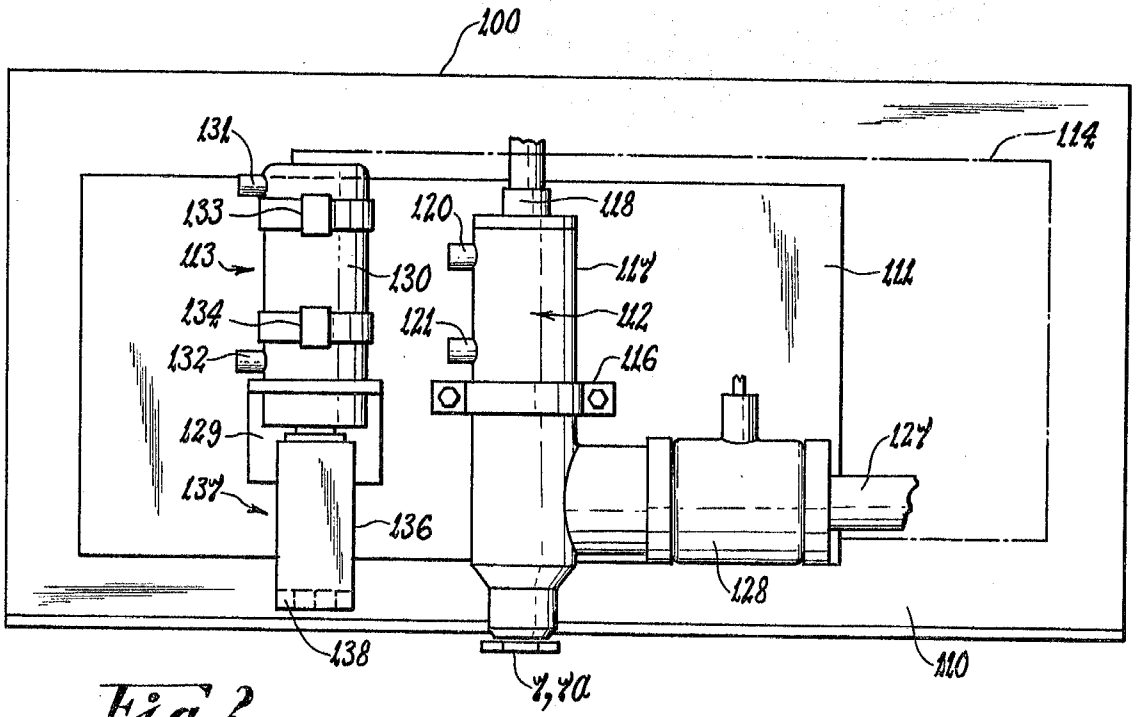
FIG. 2 is a front elevation of a filling device which may be mounted above the feeding apparatus of FIG. 1.

A filling device constructed along the lines of the filling device shown in FIGS. 2 and 3, may be mounted above the feeding assembly shown in FIG. 1. The filling device fills through the spout of a Fattori valve held by the gripper arms, and activates the air cylinders to release the closure when the filling operation is completed.

To illustrate the operation of the aforesaid feeding apparatus in more detail, the steps involved in a typical cycle are listed below:

(i) At the beginning of a cycle, the gripper arm 7A is in the "closed" position corresponding to that shown by the faint lines in the drawing, and the gripper arm 7 is in the "open" position, illustrated in heavy lines.

(ii) Protruding feed members such as Fattori valves which are attached to each bag of the continuous web are fed from left to right between the guide rails by the roller conveyor situated beneath the arrangement shown in FIG. 1.

(iii) Each protruding valve is stopped by the gripper arm 7A which lies across its path.

(iv) A sensing device senses the presence of the valve against the gripper arm 7A, and activates the air cylinder 11 to bring the gripper arm 7 to the "closed" position, thereby holding the valve firmly therebetween.

(v) The filling machine provided above the feeding apparatus removes the closure forming part of the valve and fills the bag through the exposed open ended spout, after which the closure is replaced.

(vi) After completion of the filling operation, air cylinders 11 and 11A are activated to allow the gripper arms 7 and 7A to retract to the "open" position, thereby freeing the valve.

(vii) The weight of fluid in the bag allows the bag to move under gravity further along a downwardly sloping roller conveyor. Alternatively, a motorised conveyor may be used to move the fluid filled bag further there along.

(viii) A second sensing device detects the movement of the valve beyond the "open" gripper arms and activates the air cylinder 11A to bring the gripper arm 7A to the closed position to complete the cycle.

(ix) A separating device may be optionally provided downstream of the second sensing device to sever filled bags from the web.

(x) An ultrasonic sealing head, as described in Australian patent application 42968/78 may be provided between the filling device and the separating device for purposes to become apparent.

Referring to the FIGS. 2 and 3, the filling device generally designated 100 comprises a fixed base 110 on which is arranged a mounting plate 111 for supporting a filling head 112 and a closure removal head 113. An arrangement of pneumatic cylinders (not shown) is mounted behind the mounting plate 111 shown in FIG. 2 and is adapted to move the mounting plate 111 relative to the base 110 back and forth between two positions shown respectively by the full lines and the broken lines 114 for purposes to become apparent.

The gripper arms 7 and 7A of the feeding assembly are located so that they hold the spout (not shown) of a Fattori valve attached to a collapsible bag underneath the mounting plate 111. The two positions of the mounting plate 111 correspond to either the fill head 112 or the closure removal head 113 being positioned directly above the ends of the gripper arms 7 and 7A.

The fill head 112 is secured to the mounting plate 111 by means of a mounting bracket 116. The fill head 112 consists essentially of an outer cylindrical casing 117 (FIG. 3) accommodating a piston or plunger 118 arranged for longitudinal sliding movement therein from the illustrated position to the position indicated by the broken lines 119. Movement of the piston 118 is achieved pneumatically by air pressure supplied either through port 120 to cause the piston to move downwardly or through the port 121 to cause the piston to move upwardly. A guide member 122 is located within the cylinder 117 to act as a guide for the piston 118 and as a seal between the upper and lower chambers of the fill head.

The piston 118 has a longitudinal bore 123 extending therethrough for the purpose of providing nitrogen gas or a vacuum through the bore 123 from the top to a nozzle 134 located at the bottom end of the cylinder 117. A pressure line (not shown) is connected to the top of the piston 118 to provide either a nitrogen source or a vacuum pump to the bore 123 as required.

The piston is arranged such that up and down movement thereof opens and closes, respectively, the nozzle 124 from communication with a liquid supply chamber 125. The chamber 125 receives liquid via port 126 from supply line 127 (FIG. 2). A flow meter 128 is located in the supply line 127 to sense the amount of liquid flowing through supply line 127 and to provide a signal whereby the movement of the piston 118 can be controlled to allow accurate quantities of liquid to be dispensed through the nozzle 124. In the position of the mounting plate 11 shown in FIG. 2, the nozzle 24 is arranged in fluid-tight communication with a spout held in the gripper arms 7 and 7A.

The closure removal head 113 is secured to a metal plate 129 which is in turn secured to the mounting plate 111. Actuation of the removal head to cause operation of a closure take off mechanism 137 is carried out by a pnuematic piston (not shown) acting within cylinder 130 along the same lines as the piston 118 of the filling head 112. Hence the ports 131 and 132 provide air supply communication with an inner chamber of the cylinder 130. Reed switches 133 and 134 sense the position of the piston within the cylinder 30 and provide electrical signals to initiate the appropriate sequence of movement of the apparatus.

The closure take-off mechanism 137 is provided at the bottom of the closure removal head. The mechanism 137 comprises a base part 136 fixed to the head 113 and a circular array of take-off fingers 138 mounted on the lower part thereof. Actuation of the piston (not shown) within cylinder 30 causes the take off fingers to move inwardly toward the centre of the circle they define, thereby taking hold of a closure. Thus, with the mounting plate 111 in the position shown by broken lines 114, the take-off mechanism 137 is adjacent the closure of a spout held by the gripper arms 7 and 7A and actuation of the piston in cylinder 130 causes the closure to be gripped by the fingers 138 moving radially inwardly. The plate 111 may then be moved pneumatically in an upwards direction from that shown by the broken lines whereby the closure is removed from the spout.

The sequence of movements of one full cycle of a filling device incorporating the fill head and removal head assembly, after the closured spout of a collapsible pouch is held in place by the gripper arms 7 and 7A, is set out in the following steps:

1. The mounting plate 111 moves to the position shown by the broken lines 114 thereby positioning the bottom of the closure removal head over the closured spout held in the gripper arms 7 and 7A;

2. The pneumatic piston on the closure head 113 becomes activated to cause the take-off fingers 138 to grip the closure;

3. The mounting plate moves upwardly, sideways and downwardly, thereby removing the closure from the spout and positioning the nozzle of the fill head in the spout according to the configuration illustrated in unbroken lines in FIG. 2.

4. Vacuum is applied through the bore 123 of the fill head thereby evacuating the bag whilst the piston 118 in the fill head is in the downward position to prevent flow of liquid through the nozzle 124;

5. The piston 118 in the fill head 112 is raised and a metered quantity of liquid such as wine is dispensed through the fill head nozzle 124 and into the bag;

6. The piston in the fill head 112 is lowered and a stream of nitrogen is directed through the nozzle to purge the filled bag of air;

7. The mounting plate 111 moves upwardly sideways and downwardly to the position shown by the dotted lines 14 thereby positioning the closure back on the spout;

8. The removal head 113 releases its grip on the closure and the whole mounting plate moves back to a "START" position (not shown) wherein neither head is adjacent the gripper arms 7 and 7A.

The filling device described with reference to FIGS. 2 and 3 may be mounted above a feeding assembly of the type described with reference to FIG. 1, to provide an apparatus which may continuously and automatically feed and fill individual bags which are joined together to form a continuous web. A number of such web filling machines may be arranged in the manner shown in FIG. 4 to provide a high speed filling and cartoning system.

Figure 4:
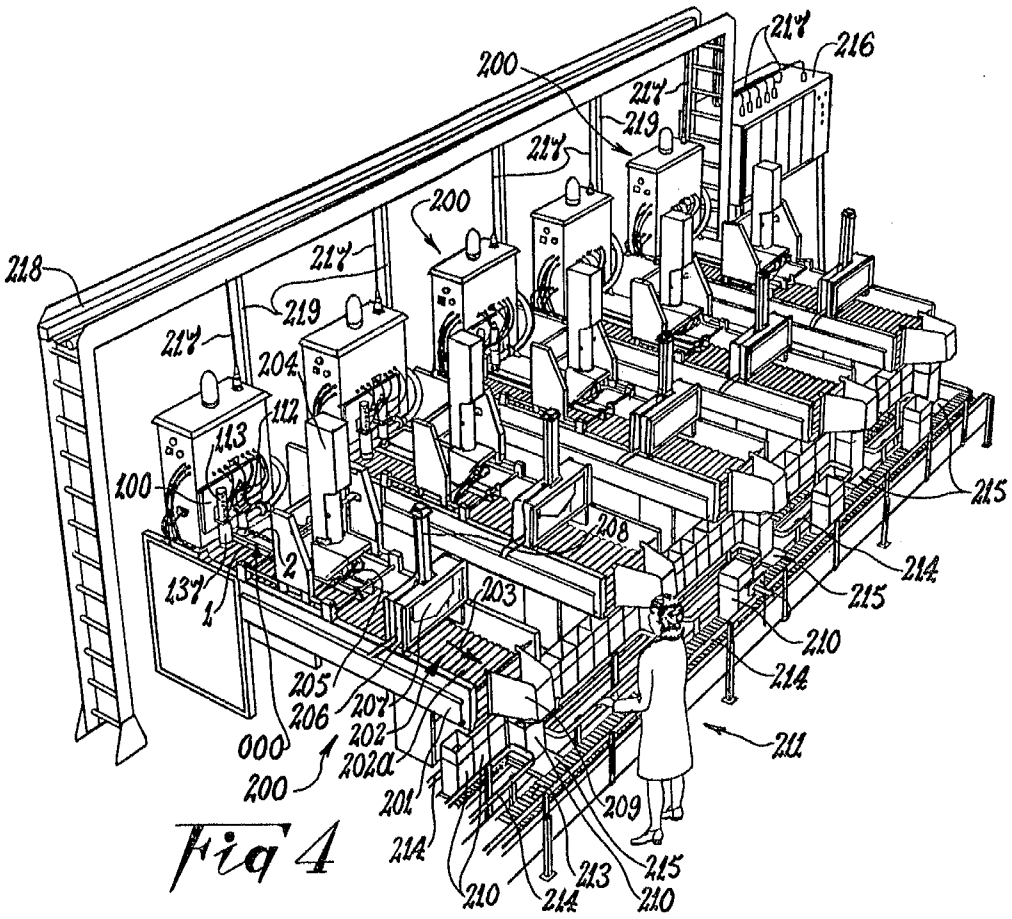
FIG. 4 is a perspective view of a multiple web bag filling assembly which incorporates the components illustrated in FIGS. 1, 2, and 3.

Referring in detail to FIG. 4, each web filling machine 200, is mounted on a frame 201 provided with conveyor means 202 which may comprise a plurality of rollers 202A which are driven to move a web of bags in the direction of arrow 203. A bag filling device 100 is mounted on the frame above the beginning of the series of rollers and the feeding assembly 000, which includes the guide rails 1 and 2, is secured thereunder in the manner illustrated.

Where it is desired to carry out further operations on the valve, the guide rails may be extended to direct the valves attached to the filled bags to one or more operating stations downstream of the filling device. In the illustrated embodiment, the guide rails extend to an ultrasonic sealing apparatus 204 which may be used to improve the seal of closures forming part of each valve. The ultrasonic sealing device comprises means for sensing the presence of a valve held between the guide rails 1 and 2 in the vicinity of the sealing device and stop means which are responsive to a signal from the sensing device to locate the valve at a fixed position. The stop means may comprise a pneumatically operated stop member 205 which is advanced between and retracted from the guide rails by the pneumatic cylinder 206 acting in accordance with signals from the sensing device. When a valve is stopped by the stop means, an ultrasonic sealing horn forming a part of the sealing machine 204 descends into contact with the closure member forming part of the valve and applies ultrasonic energy over the sealing area thereof. As the closure is most suitably formed of a plastic material, the application of ultrasonic energy has the effect of melting or softening same in the area of the seal. This allows the melted or softened area to flow into conformity with an opposed sealing surface provided by the spout, thereby improving the mating and hence sealing characteristics thereof after the flowed material has been allowed to cool and set. This technique is described in more detail in Australian patent application 42968/78.

Means for severing each filled and ultrasonically sealed bag from the web may be provided downstream of the ultrasonic sealing unit. The severing means 206 may take the form of a pneumatically operated plunger plate or rod 207 which is mounted above the roller conveyor and is synchronised with the movement of the web therealong. The pneumatic cylinder 208 is activated to move the plunger 207 down when the join between two bags of the web is located thereunder. As the join between bags forming the web is preferably perforated, the plunger 207 tears rather than cuts the bags apart and the leading edge of the plunger need not therefore be sharp.

A chute 209 is mounted at the downstream of the roller conveyor, the chute being constructed in such a manner that filled, severed bags coming off the roller conveyor are each directed to fall into an open ended carton 210 located thereunder.

A carton feeding assembly 211 is provided along the downstream ends of the web filling machines 200. The assembly comprises two separated motorised conveyors 212 and 213 which are most suitably arranged so that they run substantially parallel to each other, although they need not necessarily act in the same direction. A number of guide rails 214 may be provided at appropriate positions at locations along each of the conveyors 212 and 213. The guide rails leave open the regions where the dead plate members 215 are located in order to allow movement of cartons between the two conveyors.

Each web filling apparatus is provided with a driven pusher assembly (not shown) mounted underneath the downstream end of each roller conveyor 202 and in line with the dead plate 215. Each pusher assembly which is adapted to act in synchronism with the working of the corresponding web filler, operates to push an open ended carton 210 from the row of cartons 212 onto the dead plate 215 immediately beneath the chute 209 which directs a filled bag coming from the web filler into the carton 210 therebelow. When the pusher assembly repeats the carbon pushing for the next cycle of the operation, the filled carton already on the dead plate is pushed onto the outgoing product conveyor 213 by the newly advanced empty carton.

The operation of a bank of identical web filling apparatus, such as the five units illustrated in FIG. 4, is preferably synchronised in order that the filled cartons resting on the dead plate members 215 are all pushed onto the outgoing product conveyor 213 simultaneously. This prevents filled cartons already travelling on conveyor 213 from being crushed against other cartons being pushed onto the conveyor by web fillers which are not synchronised.

A master control console 216 which monitors the progress of all operations of each of the web filling machines through the cables 217 is provided to ensure that all filling machines which are running are kept in synchronism and that any machine which falls out of synchronism is automatically stopped. The control console may also include counting means which display the number of bags filled by each web filling machine.

The web filling machines may also be supplied by a common liquid supply line 218 which supplies liquid to the individual fillers through the branch lines 209.

During operation of the bank of web filling machines, each machine is supplied at its upstream end with a web of bags (not shown), each bag being provided with an upstanding Fattori valve. The driven conveyor assemblies 202 feed the bags and hence the Fattori valves between the guide rails 1 and 2 which extend underneath the filling devices 100. As each Fattori valve approaches a predetermined position underneath the filling and closure removal heads, the presence of the valve is sensed by a sensing device which stops the conveyor and activates the gripper arms 7 and 7A which hold the spout of the valve while the filling device 100 fills the bag in the manner described with reference to FIGS. 2 and 3. At the same time, the Fattori valve of a bag which is downstream of the filling device is subjected to the ultrasonic sealing process as hereinbefore described and the severing means 206 separate each filled end bag from each web. Simultaneously, each plunger assembly pushes an empty carton 210 onto a dead plate assembly 215, thereby pushing a filled carton onto the outgoing product conveyor 213. Once the filling operation has been completed, for each bag on each machine, the gripper arms retract, and the conveyor is restarted to feed the web one further bag length after which the sequence of operations is repeated.

Whilst the foregoing description relates to a bank of such fillers which are synchronised, it is also possible to run such machines asynchronously, provided that precautions are taken to ensure that cartons pushed off the dead plate members 215 are not pushed into cartons already travelling along the outgoing product conveyor 213. For example, this can be achieved by sensing the presence of cartons on the conveyor 213 when they are in the region of the outlets from the various dead plates. When a filled carton is in a region where there is a likelihood of collision, the sensing means prevent the pusher assembly from pushing out a further carton until the carton on conveyor 213 has been moved out of the region where collision can occur.

I claim:

1. An assembly which simultaneously fills a plurality of webs of bags, separates filled bags and places them in outer containers, said assembly comprising a plurality of driven web conveyors which are each adapted to feed an elongated web of bags provided with a protruding feed member through which the bags may be filled, guide means provided in association with each web conveyor, said guide means adapted for guiding the movement of said feed members to a filling machine mounted above each said web conveyor, each said filling machine including gripping means for holding a feed member and being adapted to fill said bags through each feed member held by said gripping means, a separating device capable of separating filled bags from the web mounted above each said web conveyor downstream of each said filling machine, an elongated container feed conveyor running along the downstream ends of said web conveyors, a chute provided at the downstream end of each web conveyor, each said chute being adapted to direct filled bags provided by said web conveyor to drop therethrough under gravity into outer containers provided by said container feed conveyor and pusher means provided at the downstream end of each web conveyor, each said pusher means acting to push each outer container onto an elongated container outlet conveyor which runs substantially parallel to said container feed conveyor.

2. Apparatus according to claim 1 wherein each said chute is located above a dead plate member provided between said container feed conveyor and said container outlet conveyor, and each said pusher acts to push an outer container from said conveyor feed conveyor onto a dead plate member thereby pushing a filled outer container from said dead plate member onto said container outlet conveyor.

3. Apparatus according to claim 1 wherein the operation of each said web conveyor, filling machine, gripping means, separating device and pusher means are synchronised.

4. Apparatus according to claim 3 wherein each said motorised web conveyor simultaneously stops when each said gripping means holds a feed member and each said filling machine, separating device and pusher means operate when each said web conveyor is stopped.

5. Apparatus for feeding and filling an elongated continuous web of bags which are each provided with a protruding feed member through which the bags may be filled, including a filling machine, a single straight web conveyor, guide means including a pair of opposed elongate guide rail members which extend in the direction of the length of said web conveyor, mounted above said conveyor, said guide means being arranged to guide the movement of each said protruding feed member, sensing means for sensing the presence of each feed member being guided by said guide means and gripping means responsive to said sensing means for holding each said feed member, said gripping means including a pair of fluid operated gripper arms pivotally mounted on either side of said guide rail members, whereby said gripper arms can move to the front and back of each said feed member to hold it rigidly in position beneath said filling machine and may retract to allow each said feed member to move along said guide rail member downstream of said filling machine, said filling machine including means for evacuating, filling with liquid and purging with nitrogen each said bag, and severing means adapted to sever filled bags from said web mounted above said web conveyor downstream of said filling machine.

6. Apparatus according to claim 5 wherein said filling machine includes means for removing and replacing a closure member which forms part of said feed member.

7. Apparatus according to claim 5 including container feeding means which are adapted to direct each said filled bag into an open ended outer container.

8. Apparatus according to claim 7 wherein said container feeding means comprise a chute mounted at the downstream end of the web conveyor and above a dead plate member, a container feed conveyor which is adapted to feed open ended outer containers to a region in the vicinity of the downstream end of said web conveyor and pusher means which are arranged to push outer containers from said container feed conveyor onto said dead plate member.

9. Apparatus according to claim 5 wherein said sensing means comprise any one of the group comprising a photoelectric detector, a reed switch and a pneumatic switch.

* * * * *